United States Patent [19]

Ciniglio

[11] Patent Number: 5,072,761

[45] Date of Patent: Dec. 17, 1991

[54] SKEINING DEVICE

[75] Inventor: Alexander J. Ciniglio, Brentwood, England

[73] Assignee: Pillarhouse International Limited, United Kingdom

[21] Appl. No.: 595,349

[22] Filed: Oct. 10, 1990

[30] Foreign Application Priority Data

Oct. 11, 1989 [GB] United Kingdom ..... 8922934

[51] Int. Cl.[5] ..... B65H 54/56

[52] U.S. Cl. ..... 140/92.2; 242/53

[58] Field of Search ..... 140/92.2, 92.1; 242/7.05 B, 53

[56] References Cited

U.S. PATENT DOCUMENTS 4,620,571 11/1986 Whellams .
4,632,156 12/1986 Whellams ..... 140/92.1

FOREIGN PATENT DOCUMENTS

0223226A2 5/1987 European Pat. Off. .
0298773A1 1/1989 European Pat. Off. .
0329465A1 8/1989 European Pat. Off. .
2939619 4/1979 Fed. Rep. of Germany .
3110867 3/1981 Fed. Rep. of Germany .
3302999 1/1983 Fed. Rep. of Germany .
2073795 10/1981 United Kingdom .
2093382 9/1982 United Kingdom .
2049748 2/1983 United Kingdom .
2114032 8/1983 United Kingdom .
2184465 6/1987 United Kingdom .

*Primary Examiner*—Lowell A. Larson
*Attorney, Agent, or Firm*—Gunn, Lee & Miller

[57] ABSTRACT

In a skeining device for skeining wire fed to a coil winding apparatus, a shuttle member loops the wire around front and rear retaining members and the loops are then twisted to form the skein. The wire is under greatest tension when being pulled from the rear retaining member to the front retaining member and so the shuttle member is driven at a slower speed during this part of the skeining operation. Also, the shuttle member is reversible along its path to allow optimum positioning of the shuttle when twisting the skein and when wire passes rapidly through the device during coil winding.

8 Claims, 3 Drawing Sheets

SKEINING DEVICE

INTRODUCTION

This invention relates to skeining devices.

The leads to electrical coils, such as solenoid and relay coils, are normally reinforced by being skeined, i.e. multiplexed and then twisted.

Automatic and semi-automatic skeining devices are already in use, such as those described in UK Patent Specification 2049748A. The present invention relates more particularly to improvements in such automatic machines.

BACKGROUND

GB2049748A which is incorporated herein by reference describes a skeining device comprising retaining members located adjacent the path of wire through the machine. A shuttle member carryies a wire guide in the form of an eye, and moves the wire guide around a closed loop path surrounding the retaining members to retain the wire on the members to multiplex the wire. A drive reciprocates the shuttle member along a rectilinear path substantially parallel to the path of the wire through the device and reciprocates the wire guide laterally of of the wire path to follow the closed loop path around the retaining members. One of the retaining members is rotated to twist the multiplexed wire to form the skein. The rotatable retaining member is in the form of a hook, and is returned to a correct orientation at the conclusion of rotation by a positioning motor. The skein is released by stripping it from the other retaining member. A proximity switch stops the shuttle drive when the shuttle member is clear of the multiplexed wire and simultaneously starts the rotation of the rotatable retaining member. Wire is drawn rapidly through the wire guide when a coil or the like is being wound, i.e. when skeining is not being carried out. In practice the tortuous path through the guide tends to have a detrimental effect on the outer surface of the wire and can introduce strains due to the sudden opposite bending caused as the wire passes through the guide. Ideally, the wire should pass through the guide without rubbing on the guide at all when coil winding is taking place. It has already been proposed to arrange for the guide to be rotateable for straight through feeding to achieve the desired effect. During skeining however, the wire will bear on the guide as the guide loops it around the retaining members.

In any event, whenever a fine gauge wire is used for coil winding, the shuttle member must be driven at a slower speed otherwise the wire will tend to break. Similarly, a still slower shuttle speed is required to prevent breakages during skeining of lower quality wire. These factors lead to a much increased skeining time in practice, and consequently to significant slowing down of the overall coil winding and skeining operations.

It is an object of the invention to reduce this problem.

SUMMARY OF THE INVENTION

According to the invention there is provided a skeining device in which drive means for reciprocating a shuttle member, to multiplex a wire to be skeined, is arranged to move the shuttle member at two or more different speeds during each cycle of a closed path, the shuttle member moving slower generally only when the wire is looped onto the rear of two retaining members. In this way the speed of the shuttle member may be slower when the wire is under greater strain, whilst the overall time for forming a skein need not be significantly increased, and may even be reduced.

Preferably, the shuttle member is moved at a slower speed during substantially the whole time the shuttle member is between the rear member and the forward member and moving generally towards the forward member. At other times the shuttle member may be moved at speeds much in excess of the slower speed and usually in excess of the normal steady speed, for any particular gauge or quality of wire, which is used in prior art apparatus.

The invention also comprehends a skeining device in which the speed of movement of the shuttle member can be varied to match the prevailing conditions, such as the gauge of the wire to skeined.

The drive means may be arranged to reverse the movement of the shuttle member somewhat to enable a tagless skein to be formed, the trailing wire being held in use in contact with the rear retaining member, and the shuttle member being somewhat reversed immediately after skein forming has been completed to allow thereafter unimpeded feed of wire through the skeining device for coil winding.

Conveniently, the different speeds and reversal are provided by using a variable speed d.c. drive motor. However, such different speeds at least can be achieved using a clutch and gearbox or other variable drive arrangement between a drive motor and the shuttle member.

Other preferred features and advantages of the invention will be apparent from the following description and the accompanying clams.

DESCRIPTION OF THE PREFERRED EMBODIMENT

Figure 1:
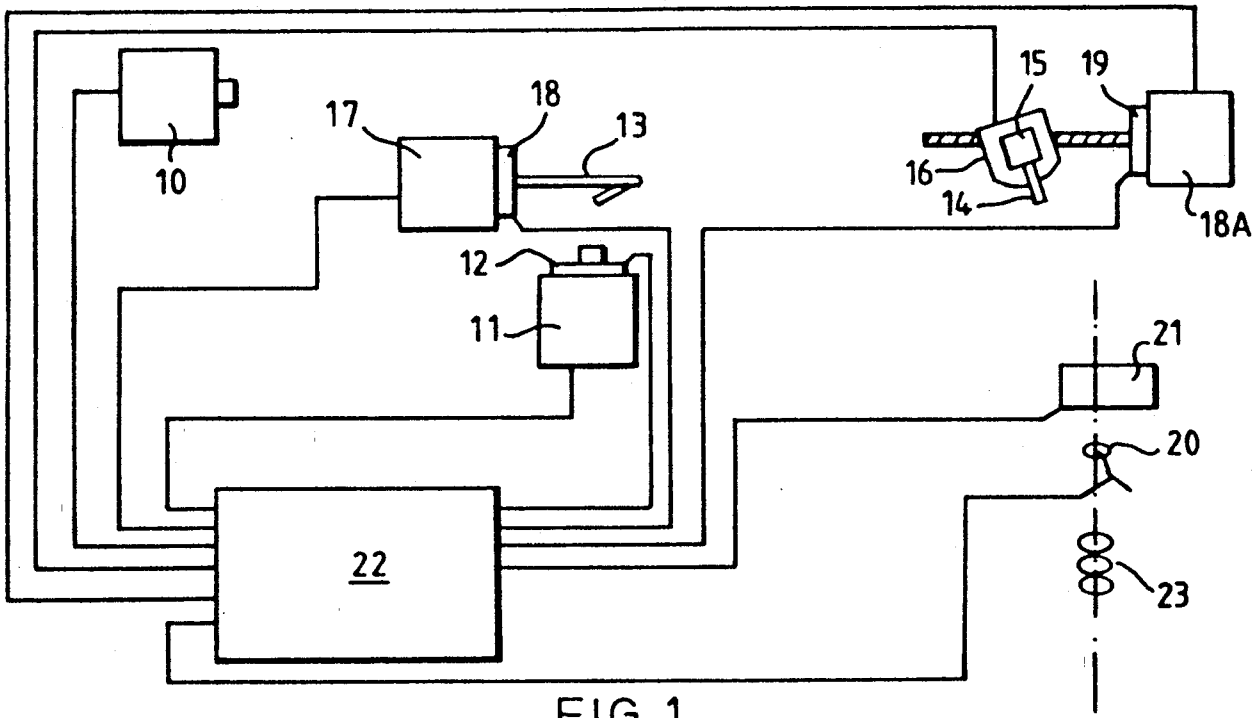
FIG. 1 shows a general layout of a skeining device according to the invention.

Referring to the drawings, in FIG. 1 a skeining device has a wire feed-through motor 10, a multiplexing drive motor 11 for a driving chain (FIG. 2), a tachometer 12 for the motor 1, two retaining members in the form of a rotatable twister needle 13 which is driven in use by a motor 17, and a rear hook 14 mounted on the plunger of a solenoid 15 carried by a carriage 16. The rotation of the needle 13 is monitored for relative position and number of revolutions by a counter 18. A carriage drive motor 18A, monitored by a tachometer 19, moves the carriage 16 as required towards and away from the needle 13. A flyer 20 is positioned adjacent an input for the wire into the skeining device and has two operative positions. A wire gauge monitor 21 and wire tensioner are also provided. A microcomputer 22 is programmed to control and monitor the operation of the skeining device as will be described more fully hereinafter.

Figure 2:
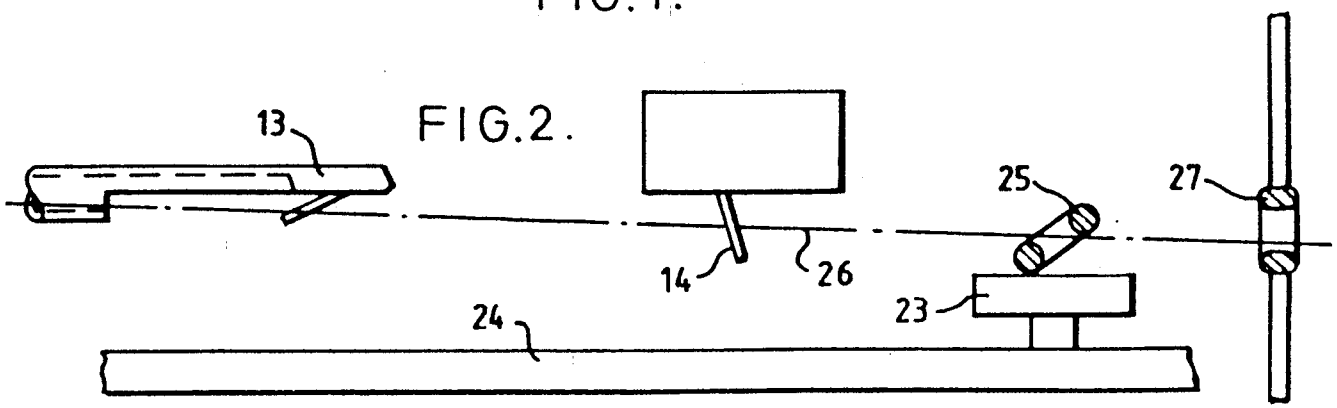
FIG. 2 shows a part of the device of FIG. 1 arranged for through feeding of wire.

Referring to FIG. 2, a shuttle 23 is driven by a chain 24 (which in turn is driven by the motor 1 of FIG. 1). A fixed circular guide 25, shown in section is, mounted on the shuttle 23 for through feed of the wire 26 between a fixed circular inlet guide 27, also shown in section, and the rotational axis of the rotatable twister needle 13. The chain 24 and shuttle 23 are stationery when no multiplexing is taking place, i.e. while wire is fed through the skeining device to a coil winding apparatus (not shown) which is situated to the left of the needle 13, the down stream or front end of the apparatus.

It will be noted that the guide 25 in this device is arranged such that the wire 26 passes uninterruptedly through the guide 25 in a manner so that the wire does not touch or barely touches the inner surfaces of the guide 25 during coil winding.

Figure 3:
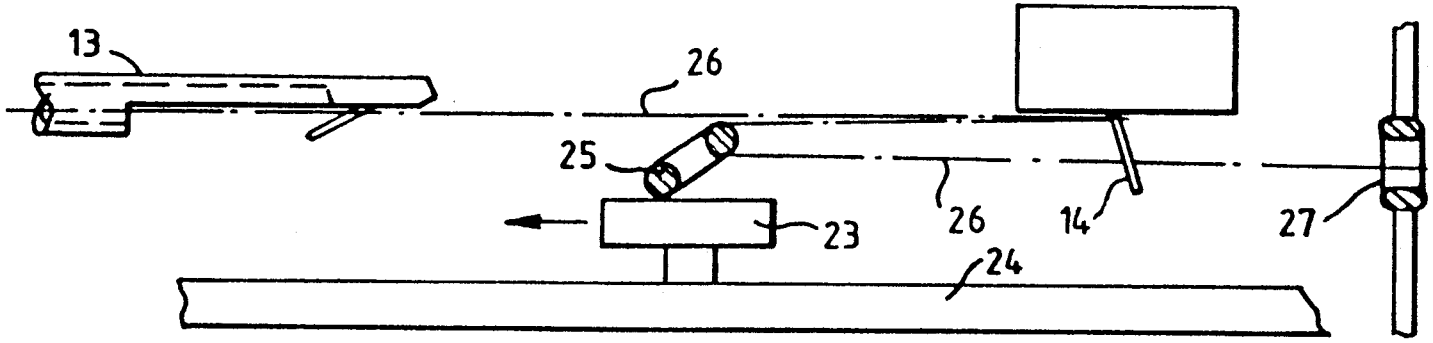
FIG. 3 shows the part of the device of FIG. 1 in one position during a multiplexing operation.
Figure 4:
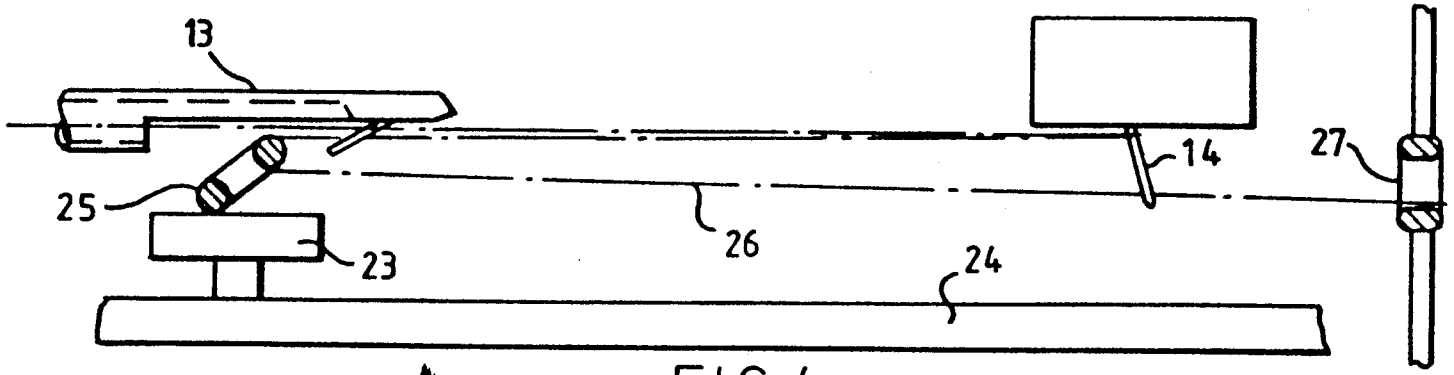
FIG. 4 shows the part of the device of FIG. 1 in another position during a multiplexing operation.

FIGS. 3 and 4 illustrate a multiplexing operation. The shuttle member 23 in the embodiment shown is constrained to reciprocate along a linear path whilst the guide eye 25 is moved from side to side, so as to be on one side of the retaining members 13, 14 during forward movement and the other side during rearwards movement. In FIG. 3, the shuttle member 23 is shown having commenced a first turn of a multiplexing sequence so that the wire 26 is positioned around the rear hook 14. The shuttle 23 has moved to pass the eye 25 sideways across the rear of the rear hook 14 and is moving forwards towards the rotatable needle 13. At the extreme left hand position of the shuttle 23 as shown in FIG. 4, the shuttle member 23 moves the eye sideways back across the front of the needle 13 to hook the wire on to the needle 13 before the shuttle returns rearwards towards the rear hook 14. It will be noted that the eye 25 has followed a closed loop path around the retaining members. As seen in FIG. 4, on the rearward path the wire 26 is engaged by the hook 14 position on the same side as the first turn. However, as the eye 25 moves to the rear, the wire 26 is pulled away under the hook 14 before the shuttle 23 lays the next turn onto the hook 14. This is facilitated by angling the hook 14 a few degrees from the vertical, that is upwards out of the plane of FIG. 4, tending to allow more easily the wire 26 stretching between the guides 25 and 27 to be released under the hook 14 as the shuttle moves rearwards. The non-vertical angle of the needle is predominantly provided to improve the wrapping of the wire 26 on to the needle 14 as the shuttle moves anti-clockwise around the needle 14 during multiplexing.

At the completion of multiplexing, the needle 13 is rotated in the normal manner to form a skein and then the hook 14 withdrawn by operating the solenoid 15 to release the skein at its rear end for onward passage through the hollow centre of the needle 13 in the usual way.

Figures 5, 6A, 6B:
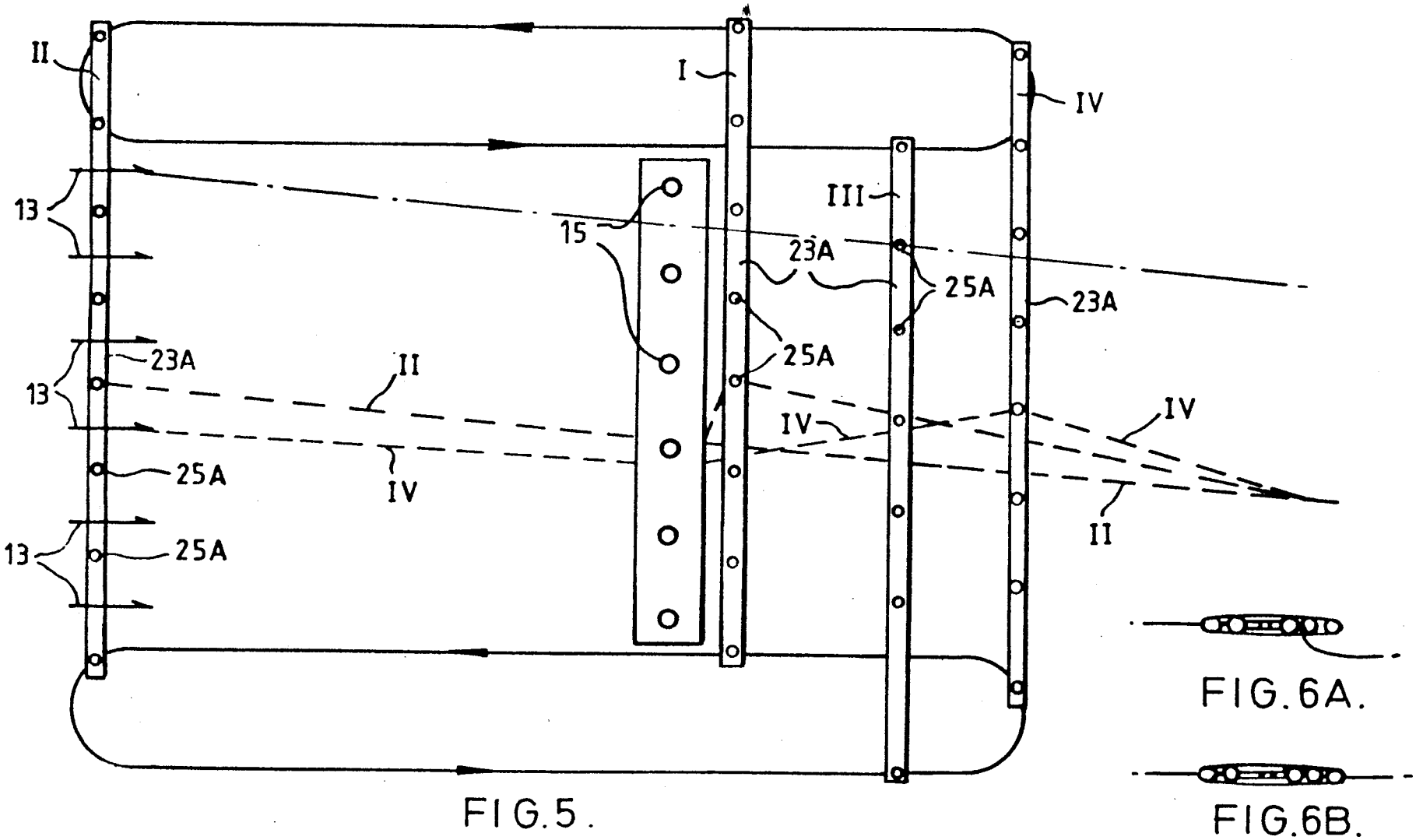
FIG. 5 shows a schematic top plan view of part of a second embodiment of the invention with a shuttle member in various positions.
FIGS. 6A and 6B show schematically two formed skeins.

A skeining machine may be arranged to skein one or several wires, each skeining position having a respective pair of hooks, etc. FIG. 5 is a plan view of a device arranged to skein in unison a substantial number (up to six in the example shown) of wires. Such a device is described more fully in DE3302999.7, which is incorporated herein by reference.

Referring to FIG. 5, by way of illustration the general path of the wire during straight passage through the skeining machine for coil winding is shown with a dot-dash line for one of the wire positions, and during skeining with a dashed line for another of the wire positions. There is some exageration of the wire paths for clarity. A shuttle member 23A is in the form of a carriage, shown in various specific positions to be explained below, and carries six guide eyes 25*a*. The shuttle member is carried at each end on two closed looped chains and is carried around an elongate, closed loop path.

At position I, when the wire is about to be looped around the rear of the rear retaining member (14) which is underneath the solenoid 15, the speed of the shuttle member 23*a*, and hence of guide eye 25*a* is significantly reduced, to 20% or less of its mean skein forming speed. The shuttle member is moved forwards at this slow speed until it reaches position II. From position II rearwards to position I, and round the closed generally rectangular path, the carriage 23*a* is driven at a high speed or speeds.

Thus when the tension applied to the wire during skeining operation would be maximum, during the forwards movement of the guide 25, the shuttle member speed is lowest. In the prior art machines, the speed of the shuttle member was conveniently and compromisingly set at this lowest speed for the whole of each cycle and the whole of the multiplexing operation. This results in a very slow skeining operation for all small gauge or poor quality coil wires. By slowing the shuttle only when the tension would be highest, and at any other peak parts of each cycle if desired, the overall time of skeining need not be significantly increased. In fact, it is often possible to retain a similar or the same time for skeining of all wires, even for small gauge wire, by slowing the shuttle only for the part of the cycle described, or somewhat less, and using a very high speed for the rest of each cycle.

During coil winding, that is when no skein forming is taking place, the shuttle member 23A are stopped in a position where the wire can pass through the skeining device without touching the front or rear hooks. Traditionally, the shuttle members is stopped in the position shown at III, where the shuttle member 23A has just moved rearwards of the rear hooks. The multiplexed wire is then twisted at this time to form the skein. This means that a side tag is formed on the side of the skein (FIG. 6A).

If the shuttle member 23A is positioned at the position shown at IV, where the guide eye 25A has passed across the rear of the rear hook (14), the wire is laid against a hook and a "tagless" skein is formed (FIG. 6B). In the described device this is made possible by having a reversible drive motor so that during skein forming the shuttle member 23A is positioned at IV and after skeining moved back to position III for the next coil winding to take place when the wire can feed unimpeded through the skeining device. Thus, in the prior art arrangements where no reversing movement along the closed path of the shuttle member was possible it was not possible, or certainly not a simple matter, to produce tagless skeins despite the considerable desirability for such skeins. It will be noted that when the skein produced in prior art devices is severed to form each coil termination, one of the terminations has its portion of the skein attached intermediate the length of the skein instead of at its end. This makes forming sound and simple connections, certainly without extra care, difficult in order not to stress the joining between the end of the wire and the intermediate length of the skein.

The guide eyes 25A of the shuttle member 23A are shaped to allow straight through passage of the wire (cf eye 25 of FIG. 1) whilst serving to loop the wire on to the retaining members 13, 14.

In the described devices, the facility of having a variable speed motor, conveniently a d.c. stepper motor, considerably enhances the performance and versatility of the device. Importantly, the overall time required to form skeins even with very small gauge wire is not necessarily greatly increased, as is the case in prior art devices. The speeds throughout each of the skein forming cycles can be fine-tuned because the motor can be driven at a wide variety of speeds and slowed down significantly only in parts of each cycle where slow speeds are actually required in practice. Because the motor speed is generally or wholly adjustable, the facility of the reversing characteristic is also made use of to provide the tagless skeins as described.

I claim:

1. A skeining device for skeining wire, the device comprising front and rear retaining members, the front retaining member being adjacent an output end of the device, a shuttle member carrying a guide for guiding wire to be skeined, the shuttle member being movable to move the guide about a closed loop path to wrap the guided wire around the retaining members, wherein drive means is provided for moving the shuttle member at different speeds during the movement of the guide about the closed loop path.

2. A skeining device as claimed in claim 1, wherein the shuttle member moves at a relatively slower speed when moving from the rear retaining member towards the front retaining member and at a relatively faster speed when moving from the front retaining member towards the rear retaining member.

3. A skeining device as claimed in claim 2, wherein the shuttle member is driven by means of a DC stepper motor.

4. A skeining device as claimed in claim 3, wherein the movement of the shuttle member is reversible over at least part of its path.

5. A skeining device for skeining wire which is fed through the skeining device, the device comprising front and rear retaining members, the front retaining member being adjacent an output end of the device, a shuttle member carrying a guide for wire to be skeined, the shuttle member being movable to move the wire about a closed loop path to wrap the guided wire around the retaining members, and a retaining member being rotatable to twist the skein, wherein means is provided to position the guide member to the rear of the rear retaining member to lay the wire against the rear retaining member during twisting of the skeins and to reverse the travel of the shuttle member to position the guide to one side of the rear retaining member during feeding of the wire through the skeining device.

6. A method of skeining wire, the method comprising feeding the wire from a wire supply, looping the wire about front and rear retaining members, the rear retaining member being proximal of the wire supply, and twisting the looped wire to form the skein, wherein the wire is looped about the retaining members by means of a wire guide which is moved about a closed loop path around the retaining members, the wire guide pulling the wire from the wire supply as it moves from the rear to the front retaining member, wherein the wire guide is moved at a relatively slower speed when moving from the rear towards the front retaining member and a relatively faster speed when moving from the front towards the rear retaining member.

7. A method of skeining wire which is fed from a wire supply through a skeining device, the method comprising feeding the wire from the wire supply, looping the wire about front and rear retaining members, the rear retaining member being proximal of the wire supply, and twisting one of the retaining members to form the skein, wherein the wire is looped about the retaining members by means of a wire guide which is moved about a closed loop path around the retaining members, and after the wire is looped on the retaining member and before the said one retaining member is twisted, the wire guide is positioned to lay the wire against the rear retaining member, and after the retaining members twisted, the wire guide is moved backwards along the closed loop path to bring the wire clear of the rear retaining member during feeding of the wire through the skeining device.

8. A method of skeining a continuous length of wire which is fed through a skeining device, the device having a rear retaining member proximal of an inlet end of the device and a front retaining member proximal of an outlet end of the device, the method comprising looping the wire about the retaining members by means of a wire guide which is moved about a closed loop path around the retaining members, and twisting one of the retaining members to form the looped wire into a skein, wherein after looping the wire and before twisting the said one of the retaining members, the wire guide is passed across a notional line passing through the front and rear retaining members to pass behind the rear retaining member when viewed from the front retaining member, so as to lay the wire against the rear retaining member, and after the said one retaining member is twisted to form a skein the wire guide is moved backwards across the notional line to position it to one side of the notional line through the front and rear retaining members to hold the wire clear of the rear retaining member during passage of the wire through the device.

* * * * *